US008769835B2

(12) United States Patent
Lüttgens

(10) Patent No.: US 8,769,835 B2
(45) Date of Patent: Jul. 8, 2014

(54) PENCIL SHARPENER AND METHOD OF PRODUCING IT

(75) Inventor: Fritz Lüttgens, Erlangen (DE)

(73) Assignee: Kum Limited, Trim County Meath (IE)

( * ) Notice: Subject to any disclaimer, the term of this patent is extended or adjusted under 35 U.S.C. 154(b) by 1350 days.

(21) Appl. No.: 11/638,878

(22) Filed: Dec. 14, 2006

(65) Prior Publication Data

US 2007/0137051 A1 Jun. 21, 2007

(30) Foreign Application Priority Data

Dec. 15, 2005 (EP) ..... 05027490

(51) Int. Cl.
*B43L 23/08* (2006.01)
*B25G 1/10* (2006.01)

(52) U.S. Cl.
USPC ..... 30/454; 30/458; 16/430

(58) Field of Classification Search
USPC ..... 30/454, 458, 354, 457, 459; 16/110.1, 16/430; D19/73
See application file for complete search history.

(56) References Cited

U.S. PATENT DOCUMENTS

| | | | | | |
|---|---|---|---|---|---|
| 1,719,714 | A | * | 7/1929 | Miller | 30/457 |
| 2,421,339 | A | * | 5/1947 | Leger | 30/165 |
| 2,653,576 | A | * | 9/1953 | Slattery | 30/455 |
| D226,736 | S | * | 4/1973 | Benis | D28/61 |
| D237,174 | S | * | 10/1975 | Hoffman | D19/84 |
| D267,147 | S | * | 12/1982 | Jannard | D8/303 |
| 4,885,818 | A | * | 12/1989 | Arterbury | 16/430 |
| 4,934,024 | A | | 6/1990 | Sexton | |
| 5,076,569 | A | * | 12/1991 | Gootter | 482/49 |
| 5,761,767 | A | * | 6/1998 | Barton | 16/430 |
| 5,979,015 | A | * | 11/1999 | Tamaribuchi | 16/110.1 |
| 6,637,481 | B2 | * | 10/2003 | Mak et al. | 144/28.5 |
| 7,506,409 | B2 | * | 3/2009 | Tillim | 16/430 |

FOREIGN PATENT DOCUMENTS

| | | | |
|---|---|---|---|
| DE | 38 05 997 | A1 | 9/1988 |
| DE | 199 02 882 | A1 | 8/2000 |
| DE | 203 20 914 | U1 | 8/2005 |
| GB | 359 555 | | 10/1931 |
| GB | 2 308 328 | A | 6/1997 |
| GB | 2 316 315 | A | 2/1998 |
| WO | WO 03/035331 | A2 | 5/2003 |

* cited by examiner

*Primary Examiner* — Hwei C Payer
(74) *Attorney, Agent, or Firm* — Laurence A. Greenberg; Werner H. Stemer; Ralph E. Locher

(57) ABSTRACT

A pencil sharpener (1) with a handle (3) and a sharpener insert (4) inserted into the handle (3) with a pencil guide channel (33) and a paring blade (34) is proposed, in conjunction with which the handle (3) is formed so as to correspond at least partially to the inner contours of a curved human hand (26). Improved ease of handling is achieved through the formed handle (3). Also proposed is a method for the manufacture of a pencil sharpener (1) of this kind, in which the handle (3) is formed in subsidiary areas so as to correspond to the inner contours of the human hand (26).

26 Claims, 5 Drawing Sheets

PENCIL SHARPENER AND METHOD OF PRODUCING IT

BACKGROUND OF THE INVENTION

Field of the Invention

The invention relates to a pencil sharpener for sharpening a writing pencil, artist's pencil or cosmetic pencil.

Conventional pencil sharpeners as a rule comprise a sharpener body, in which a cone-shaped pencil guide channel is arranged. A paring blade arranged laterally on the pencil guide channel removes material from a pencil rotating in the pencil guide channel, which results in sharpening of the pencil. With a view to receiving sharpening waste, container sharpeners are previously disclosed, in which a sharpener insert with a pencil guide channel and a paring blade is detachably attached to a container. By detaching the sharpener insert from the container, the latter can be emptied.

Previously disclosed in GB 359,555A, for example, is a container sharpener, of which the cylindrical container is adapted to the size of a human hand.

Various utility objects are also previously disclosed, in which sharpener inserts are integrated in order to offer the possibility of sharpening in conjunction with the use of the utility object concerned. Accordingly, previously disclosed in GB 2 316 315A is a finger-positioning device, which, when it is gripped, positions the fingers of a human hand for the purpose of manicuring. Introduced at the bottom end of the finger-positioning device is a sharpener insert, which affords the possibility of sharpening cosmetic pencils. Also previously disclosed in GB 2 308 328A is a saw, in the handle of which a sharpener insert is integrated.

In order to sharpen a pencil in the manner described, it is necessary for a certain turning moment to be applied by a user in order to cause the pencil to be sharpened to rotate against the paring blade.

SUMMARY OF THE INVENTION

The object of the invention is to propose a pencil sharpener with improved ease of handling. A further object of the invention is to make available a method for the manufacture of a pencil sharpener improved in this way.

The first-mentioned object is achieved according to the invention by a pencil sharpener comprising a handle with a central longitudinal axis and a sharpener insert with a pencil guide channel and a paring blade inserted in the handle along the longitudinal axis, the handle comprising a base capable of being gripped by a human hand with the thumb and the index finger, the base being provided with a formed thumb support groove running partially around the longitudinal axis and lying opposite it at least one finger support groove running partially around the longitudinal axis.

The invention is based on the notion that the ease of handling of a pencil sharpener can be improved by improving the linking of the pencil sharpener to the human user. For this purpose, the sharpener insert is inserted along the longitudinal axis in a handle, which can be gripped firmly as such by a human hand. The human/tool interface is further improved in that the handle is formed at least partially in order to suit the internal contours of a curved human hand. In other words, the handle exhibits at least subsidiary areas that are executed essentially in such a way as to be complementary to the inside of a curved human hand. For this purpose, the handle comprises a base that is capable of being gripped by the human hand with the thumb and index finger, there being formed in the base a thumb support groove running partially around the longitudinal axis and lying opposite it at least one finger support groove running partially around the longitudinal axis. Because the human hand is designed as a gripping hand, in which the thumb is positioned opposite the other fingers, the handle is held comfortably and securely in this way between the thumb and at least one of the other fingers. It is sufficient for this purpose if the handle extends along the longitudinal axis and, in the minimal case, for a distance corresponding to the dimension of approximately the width of one finger. In this case, the handle of the pencil sharpener would exhibit a flat base with a more or less oval cross section, at the edge of which the thumb support groove and the finger support groove are formed opposite one another.

Improved transmission of force by the user is achieved through the ergonomic design of the pencil sharpener with a handle that is formed in subsidiary areas to suit the internal surfaces of a curved human hand. Compared with conventional pencil sharpeners, a lower force input is required in order to achieve the turning moment necessary for the sharpening process. In addition, gripping positions of the pencil sharpener which impair the input of force are avoided. The grip is assured by the forming to suit the human hand. Incorrect grips are avoided. The ergonomic design of the pencil sharpener enables children or other users with restricted manual aptitudes in particular to perform the sharpening process easily and without problems. An additional benefit is that a handle of this kind combined with the facility of the sharpening process itself means that users willingly pick up the pencil sharpener. Children in particular are encouraged to perform sharpening more frequently.

The handle can be formed in principle to suit various subsidiary areas of the curved human hand. Forming is particularly desirable in order to correspond to the pressure gripping points via which the human hand exerts a force on an object when gripping it. These can be the palms of the hands, for example, or the surfaces of individual fingers. If the surfaces of the handle are formed in the vicinity of the pressure gripping points of the internal contour of a human hand, the pencil sharpener as such will lie comfortably in the hand and will be easily operated.

In one advantageous further development of the invention, the handle is extended in the direction of the longitudinal axis, so that a plurality of finger support grooves running parallel with one another can be formed on the base opposite the thumb support groove. In this way, the base is formed to suit the internal contour of the human hand at the point at which the finger support grooves are formed, in such a way that the finger support grooves are separated from one another by interjacent steps. In this way, the handle fits into the hand that encloses it.

In a further advantageous embodiment of the invention, the handle is formed essentially to correspond to the shape of the body formed by the interior of a curved human hand. For this purpose, the base is surrounded in its longitudinal axis essentially by a first, a second, a third and a fourth wall surface, which wall surfaces are formed in such a way as to blend softly into one another in the peripheral direction. Each of the four wall surfaces exhibits a specific surface characteristic. The surface characteristic, that is to say the position and form of the surface in three-dimensional space, can vary, for example, from wall surface to wall surface in terms of its curvature both in the direction of the longitudinal axis and in the peripheral direction, and also in terms of applied surface structures, such as finger support grooves. The first wall surface in particular corresponds to a thumb support surface, in which the thumb support groove is introduced. The second wall surface corresponds to a support surface for the ball of the thumb and makes contact with the ball of the thumb and, where appropriate, with a part of the metacarpus of the human hand when the base is enclosed by it. The third wall surface forms a finger support surface, in which the finger support grooves in particular are formed. The fourth wall surface is executed as a peripheral end surface, the dimension of which is determined by the extent of the base. In the event that the base is capable of being gripped in its entirety by a human hand, the fourth wall surface may be arranged so that it forms only the transition between the first and the third wall surface. If the base is dimensioned in such a way that it is not capable of being gripped in its entirety by a human hand, the fourth wall surface corresponds to the open part of the base lying between the thumb and the index finger of the human hand that is not gripped.

To support the ball of the thumb, the second wall surface or the support surface for the ball of the thumb is arranged in the form of a saddle. For this purpose, the support surface for the ball of the thumb exhibits a concave curvature in the direction of the longitudinal axis and a convex curvature in the peripheral direction.

In one appropriate embodiment, the first wall surface or the thumb support surface is also executed in the form of a saddle. In conjunction with this, a concave curvature of the thumb support surface in the longitudinal direction arises as a result of the applied thumb support surface. The execution of the curvature of the thumb support surface in the peripheral direction lies in the range between convex with a small curvature and flat.

In one advantageous further development of the invention, the third wall surface or finger support surface possesses an essentially arched cross section with a vertex running transversely to the longitudinal axis. In this case, the one or more finger support grooves is/are formed in relation to the vertex, so that the vertex line running parallel to the longitudinal axis on the wall surface possesses an undulating course. The remaining surface area of the third wall surface is essentially smooth. In this embodiment, the finger support grooves together with the interjacent steps constitute the support surface for the finger area of the rear phalanges. These are positioned opposite the thumb in a loosely curved human hand. In other words, pressure gripping points for a loosely curved human hand are formed in the vicinity of the rear phalanges by a base of the handle of this kind, as a result of which an ideal input of force can be applied for the purpose of sharpening. The handle in this case lies ergonomically in a loosely curved human hand. Incorrect holding of the pencil sharpener is reliably prevented by the fact that the finger support grooves are arranged essentially in the area of the vertex line of the third wall surface.

As already mentioned, the fourth wall surface serves as a peripheral end surface. Whereas the first, second and third wall surfaces are formed to suit the inside of a curved human hand with corresponding dimensioning of the base of the handle, the configuration of the fourth wall surface remains open. Depending on whether the first, second and third wall surfaces are arranged in a clockwise or anti-clockwise sense in the peripheral direction, the result will be a pencil sharpener suitable for left-handed or right-handed individuals.

An advantage of forming the fourth wall surface similarly to the second wall surface is that a standardized configuration of the handle will be possible for both left-handed and right-handed individuals. In this case, the fourth wall surface for a left hand forms a peripheral end surface that is not gripped by the hand. The second wall surface here is formed as the support surface for the ball of the thumb. For a right hand, however, the fourth wall surface at the same time forms a support surface for the ball of the thumb and is formed in the shape of a saddle, for example. The second wall surface then performs the function of the peripheral end surface and is not gripped by the human hand. The design of the handle described here also makes it possible to create a standardized pencil sharpener, which exhibits an ergonomically designed handle suitable for both left-handed and right-handed individuals.

A projecting upper flat surface perpendicular to the longitudinal axis is appropriately formed on the base of the handle. What is achieved in this way is that the pressure required for sharpening applied against the hand in the direction of the longitudinal axis does not result in slipping of the handle in the hand. This is reliably prevented by the projecting upper flat surface, since this lies in contact with the curved human hand when the base is being gripped.

Finger recesses intended to support the thumb and the index finger are appropriately formed beneath the projecting part of the upper flat surface. Individual pressure points on the human hand, which would be uncomfortable for the user when performing the sharpening process, are prevented in this way. This also leads to an improvement in the interface between the human hand and the tool.

In order to set down the pencil sharpener, it is advantageous for a projecting lower flat supporting surface perpendicular to the longitudinal axis to be formed on the base. If the lower supporting surface consists of two mutually inclined flat surfaces, it is possible to economize on material in the handle in this way. At the same time, this design permits the pencil sharpener to be set down in two possible positions. It is also possible for a free finger that is not being guided in a finger support groove to be placed comfortably on the inclined surface.

The sharpener insert is inserted advantageously into the base more or less centrally and parallel to the longitudinal axis. An ideal force input by the human hand into the pencil sharpener is achieved in this way, in order to apply the turning moment necessary for the sharpening process.

In further advantageous embodiments of the invention, the sharpener insert is inserted into a bore intended to receive sharpening waste. For the purpose of removing the sharpening waste, either the sharpener insert can be detachably inserted, or the bore can penetrate the base to its full extent, so that a cover to permit emptying the bore can be applied to the floor of the base opposite the sharpener insert.

In a further advantageous embodiment, the handle consists of materials possessing different elasticity. The handle is thus able to exhibit a material of high elasticity at the points of pressure on the hand, and a material of lower elasticity elsewhere. The softer and more highly elastic material in this case gives way to the points of pressure on the hand, whereas the harder material with its lower elasticity controls the specified loading of the handle. An optimal gripping position can be specified in this way.

The second-mentioned object is achieved according to the invention by a method for the manufacture of a pencil sharpener, according to which an essentially cylindrical body having more or less the same dimensions as a human hand made from a formable mass is provided with a place holder aligned along the cylindrical axis in order to create room for the sharpener insert, the body being securely gripped manually, for which purpose at least a part of the internal contours of a human hand are formed on the body, in conjunction with which the formed body is either inserted with the place holder removed, as appropriate, as a rough pattern, with the help of which the handle is manufactured by means of a forming process technology, in particular a casting, pouring, injecting, turning, milling or laser machining technology, or the formed body for the handle is cured, in conjunction with which the place holder is removed before or after curing, as appropriate, and in conjunction with which a sharpener insert is inserted into the place holder or into the opening created by the place holder.

This manufacturing process makes it possible by simple means to create a pencil sharpener that exhibits a handle, which is formed partially to correspond to the internal contours of a curved human hand. The handle is created to some extent as an impression of the human hand. For this purpose, it is possible in a previously disclosed manner to utilize the impression of a human hand as a basic pattern or a rough pattern for further familiar production technologies. In particular, a female mould or a casting mould can be produced from the rough pattern, by means of which the handle for the pencil sharpener can be manufactured, for example by plastic injection molding. In this variant, the impression of the human hand, once it has been created, can serve as the pattern for a series-manufactured pencil sharpener.

It is also possible, as an alternative, to manufacture every single one of the pencil sharpeners in such a way that the body is gripped by the human hand of the eventual user him/herself, as a consequence of which the user's own hand is formed on the handle of the pencil sharpener. A pencil sharpener that is personal to the user, which fits perfectly in his or her own hand, is produced by then allowing the formed base for the handle to cure.

For the purpose of curing the formed body, this advantageously consists of a kneaded mass made of a thermosetting plastic in soft form, into which the human hand can be formed. The body is then cured, for example by a thermal treatment, which can be carried out in a domestic oven, if necessary. The personal pencil sharpener lies perfectly in the hand of the user, the result of which is an excellent force input for the purpose of achieving the turning moment necessary for the sharpening process. Children in particular are encouraged to perform sharpening frequently.

In a further advantageous embodiment, materials of different plasticity are used for the formable mass. By the use of a given distribution of materials possessing different plasticity in the cylindrical body, a certain influence can be brought to bear on the design. In particular, the use of one material possessing higher plasticity and one material possessing lower plasticity permits certain points with high deformability to be obtained, while other points will tend to retain their original form. For example, if the material possessing higher plasticity is used on the outside of the cylindrical body, and the material possessing lower plasticity is used in the interior of the cylindrical body, the softer material will yield to the hand pressure points when it is subjected to forming by the human hand, whereas the harder material will control the forming of the handle as such.

Materials of a kind that exhibit different elasticity in their final state can be used in particular in the manufacture of the pencil sharpener.

Illustrative embodiments of the invention are explained in greater detail with reference to a drawing, in which:

DESCRIPTION OF THE PREFERRED EMBODIMENTS

Depicted in FIGS. 1 to 4 from different viewpoints in a three-dimensional representation is a pencil sharpener 1, which comprises an ergonomic handle 3 and a sharpener insert 4 inserted into the handle 3. The sharpener insert 4 in this case is inserted essentially centrally along the longitudinal axis of the handle 3. Also represented is a pencil 6, in a position in which it is inserted into the pencil guide channel of the sharpener insert 4 for the purpose of sharpening. At the same time, the pencil 6 in this case defines the longitudinal axis of the handle 3 and its base that is capable of being gripped by the hand.

The base running along the longitudinal axis is surrounded by a total of four wall surfaces with characteristic properties.

Figure 1:
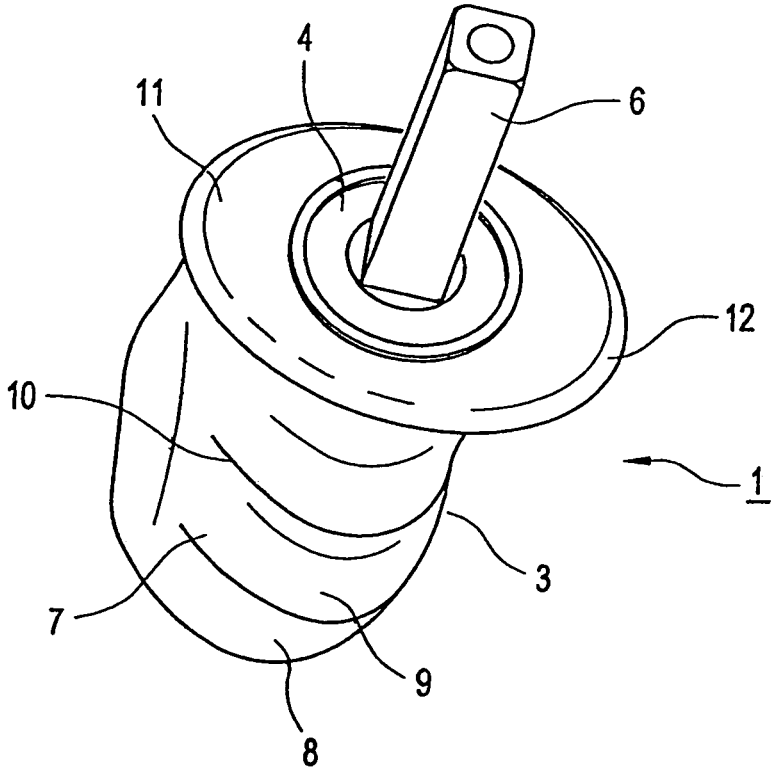
FIGS. 1 to 4 depict in a three-dimensional representation (from different viewpoints) in each case a pencil sharpener with a handle formed to correspond partially to the internal contours of a curved human hand.

In FIG. 1 the handle 3 is depicted in a view looking onto the third wall surface 7. The third wall surface 7 is executed as a finger support surface and for this purpose exhibits applied finger support grooves 8 and steps 9 running between the finger support grooves 8. The third wall surface 7 also exhibits an essentially arched course with a vertex running perpendicularly to the longitudinal axis, which is defined by the pencil 6. This can be appreciated from the contour line 10 illustrated in the figure. The finger support grooves 8 are applied in each case to the vertex, so that an undulating vertex line is produced at this point in the direction of the longitudinal axis. The third wall surface 7 is of essentially flat execution to either side of the finger support grooves 8.

Formed on the base of the handle 3 is a flat upper part 11, which exhibits a peripheral projecting part 12. The flat surface 11 projects beyond the base of the handle 3 in the form of the projecting part 12, thereby providing a support surface for the hand gripping the handle. The pressure in the direction of the pencil 6 and in the direction of the longitudinal axis required for the sharpening process is readily achievable in this way.

Figure 2:
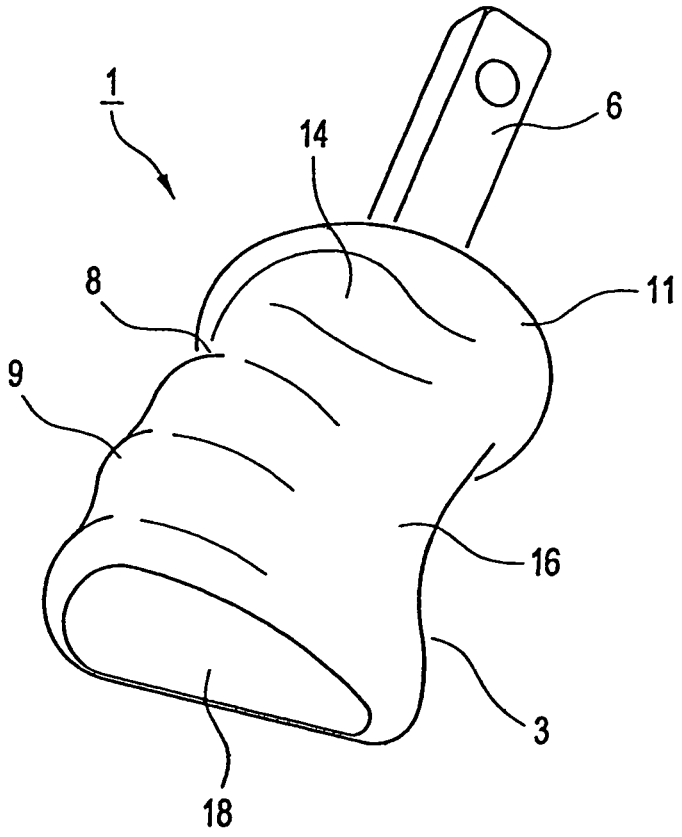

FIG. 2 depicts the pencil sharpener 1 from a different viewpoint. Compared with FIG. 1, the third wall surface 7 is turned away to the left. The finger support grooves 8 and the interjacent steps 9 can still be appreciated. The viewpoint in this case is at an angle from below towards the under side of the upper flat surface 11. In order to prevent pressure points, finger recesses 14 are formed in the under side of the upper flat surface 11.

The second wall surface 16 on the base of the handle 3 can be appreciated from the viewpoint depicted in FIG. 2. The second wall surface 16 is executed essentially in the form of a saddle. The convex curvature in the peripheral direction and the concave curvature in the direction of the longitudinal axis and the axis of the pencil can be appreciated. Because the third wall surface 7 or the finger support surface is arranged to the left of the second wall surface 16 or the support surface for the ball of the thumb, the pencil sharpener 1 depicted here is designed ergonomically for a left-handed individual.

At the opposite end to the pencil 6 and the pencil insert 4, the handle 3 exhibits a flat, lower support surface 18.

Figure 3:
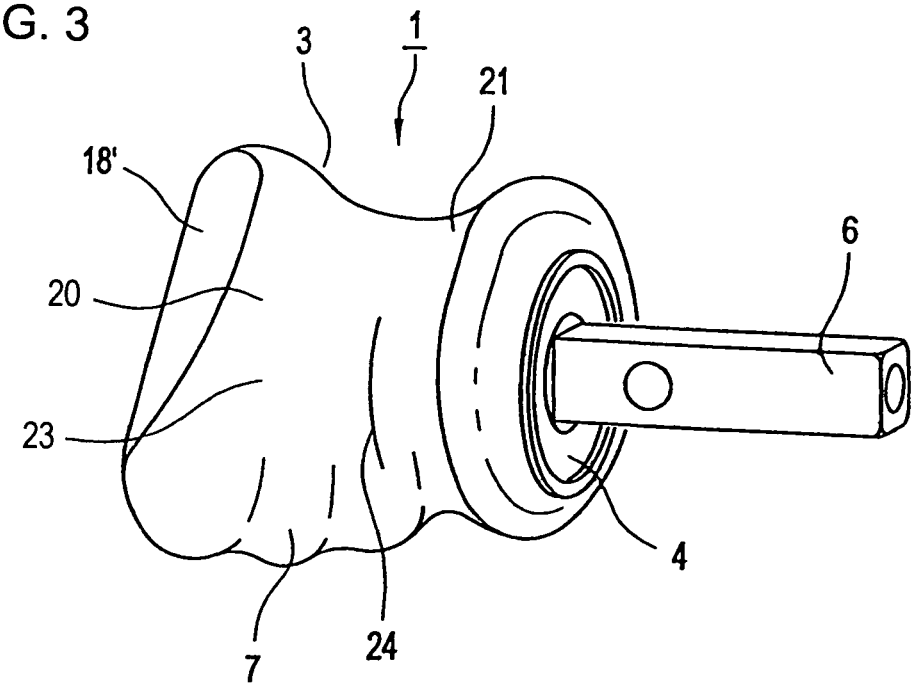

In FIG. 3, the pencil sharpener 1 is again depicted from a different viewpoint. The third wall surface 7 or finger support surface will now be appreciated on the lower edge of the handle 3. It is clear from this representation that the lower support surface 18 consists of two subsidiary surfaces that are inclined in relation to one another. The inclined, upward-facing subsidiary surface 18' is clearly illustrated in FIG. 3.

The first wall surface 20, in which a thumb support groove 21 is formed, can be seen opposite the third wall surface 7 or finger support surface. The thumb support groove 21 is of essentially flat execution in the peripheral direction. The result on the whole is a saddle-shaped form of the first wall surface 20.

The fourth wall surface 23 can be seen between the first wall surface 20 and the third wall surface 7. As can be appreciated from the illustrated contour line 24, this exhibits a convex curvature in the peripheral direction and a concave curvature in the longitudinal direction. In other words, the fourth wall surface 23 is embodied similarly to the second wall surface 16, namely in the form of a saddle. If a right-handed individual grips the depicted pencil sharpener 1, the fourth wall surface 23 will serve as a support surface for the ball of the thumb. The second wall surface 16 in this case lies freely between the thumb and the other fingers and then acts as a peripheral end surface. The depicted pencil sharpener 1 is thus ergonomically designed both for a left-handed individual and for a right-handed individual.

Figure 4:
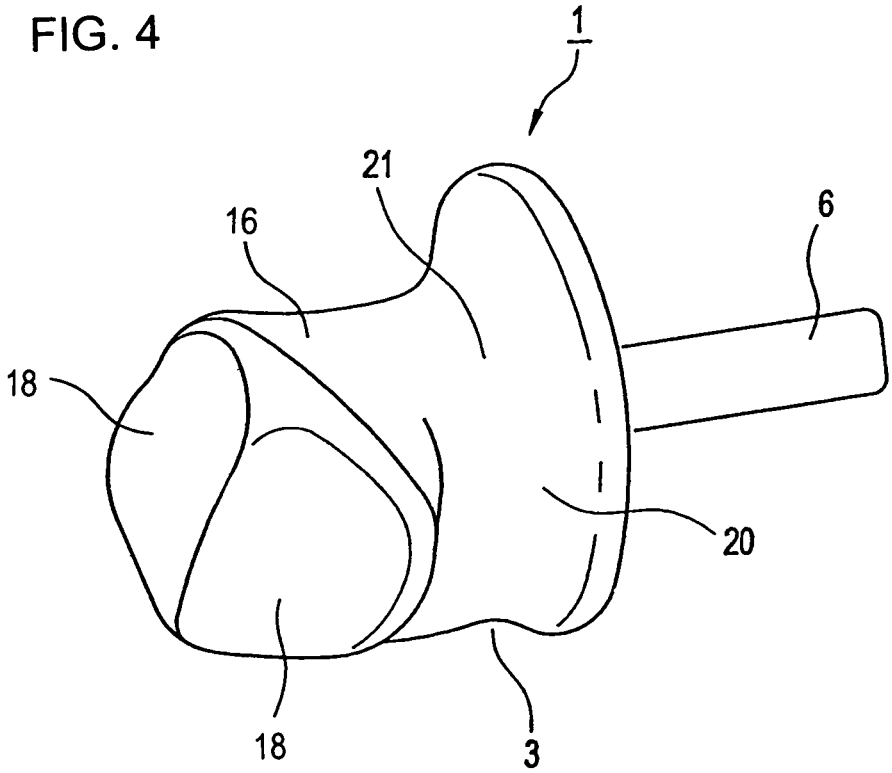

The first wall surface 20 with the thumb support groove 21 formed in it can be appreciated in particular from the viewpoint depicted in FIG. 4. The arrangement of the lower support surface 18 with an inclined part of the surface 18' can also be clearly appreciated.

Figure 5:
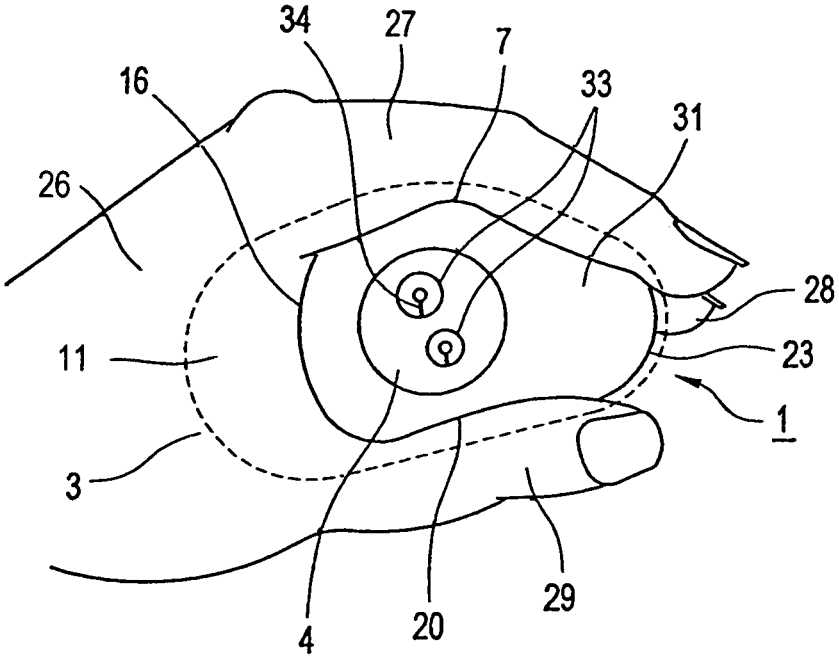
FIG. 5 depicts schematically the pencil sharpener according to FIGS. 1 to 4 as it is being gripped by a human hand.

The pencil sharpener 1 depicted in FIGS. 1 to 4 is depicted schematically in FIG. 5 as it is being gripped by a human left hand 26. The base 31 of the handle 3 can be seen lying in the human hand. The contour of the base 31 is constituted by the first, second, third and fourth wall surfaces 20, 16, 7 and 23. In this case, the first wall surface 20 is in contact with the thumb 29, the second wall surface 16 with the ball of the thumb, and the third wall surface 7 with the fingers (of which the index finger 27 and the middle finger 28 are represented here); the fourth wall surface 23 serves as a peripheral end surface. It is not enclosed by the hand 26.

Also illustrated is the upper flat surface 11 formed on the base 31 of the handle 3, which is in contact with the human hand 26 on the surface formed by the thumb 29 and the index finger 27. The outline of the flat surface 11 is depicted here as a broken line.

The sharpener insert 4 is inserted in the pencil sharpener 1 centrally into the base 31 of the handle 3. The sharpener insert 4 exhibits two pencil guide channels 33 of different diameters. Inserted in each case into each of the pencil guide channels 33, which are of conically tapering execution, is a paring blade 34 for sharpening an inserted pencil.

Figure 6:
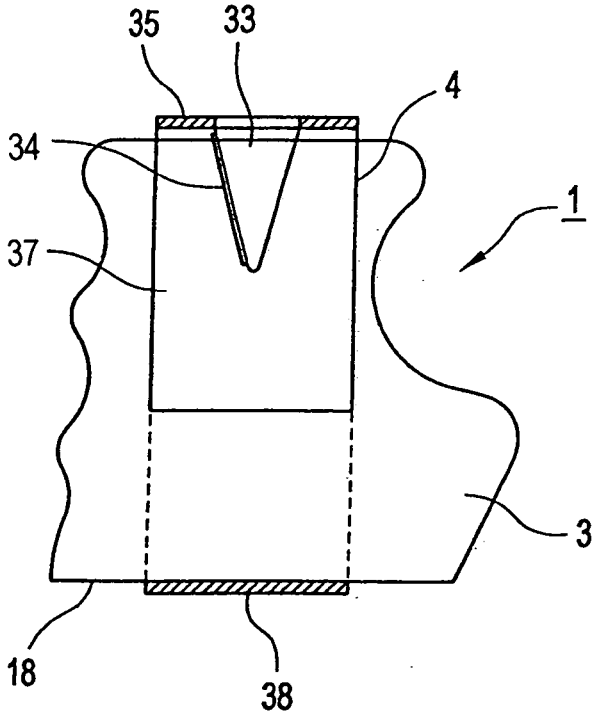
FIG. 6 depicts as a longitudinal section the sharpener insert integrated into the pencil sharpener with a bore intended to receive sharpening waste.

FIG. 6 depicts the pencil sharpener 1 with an ergonomically designed handle 3 in a longitudinal section. The sharpener insert 4 with the pencil guide channel 33 and the paring blade 34 is inserted into a bore 37 via a cover 35. The bore 37 is accommodated centrally in the base 31 of the pencil sharpener 1. The cover 35 is removable for the purpose of emptying the bore 37 of sharpening waste.

In an alternative represented by a broken line, the bore 37, which accommodates the sharpener insert 4, extends as far as the lower supporting surface 18. The bore 37 here is closed by means of a removable cover 38. In the variant embodiment indicated by a broken line, the sharpener insert 4 can be securely mounted in the handle 3. The bore 37 is emptied of sharpening waste by opening the cover 38.

LIST OF REFERENCE DESIGNATIONS

1 pencil sharpener
3 handle
4 sharpener insert
6 pencil
7 third wall surface
8 finger support grooves
9 step
10 contour line
11 upper flat surface
12 projecting part
14 finger recesses
16 second wall surface
18 lower supporting surface
18' inclined part of the surface
20 first wall surface
21 thumb support groove
23 fourth wall surface
24 contour line
26 human hand
27 index finger
28 middle finger
29 thumb
31 base
33 pencil guide channel
34 paring blade
35 cover
37 bore
38 cover

I claim:

1. A pencil sharpener, comprising:

a handle having a central longitudinal axis;

a sharpener insert inserted in said handle along said longitudinal axis, said sharpener insert having a pencil guide channel and a paring blade;

said handle having a base configured to being gripped by a human hand with a thumb and an index finger, said base having a thumb support groove formed therein running partially around said longitudinal axis and at least one finger support groove lying opposite said thumb support groove and running partially around said longitudinal axis; and a lower flat support surface being formed on said base, said lower support surface being formed of two substantially flat surfaces that are inclined relative to one another and configured to allow the pencil sharpener to be set down and supported on a surface in different positions.

2. The pencil sharpener according to claim 1, wherein said finger support groove is one of a plurality of mutually parallel-oriented finger support grooves formed opposite said thumb support groove and separated from one another by intermediate ridges.

3. The pencil sharpener according to claim 1, wherein:

said base is surrounded around said longitudinal axis substantially by wall surfaces including a first wall surface, a second wall surface, a third wall surface, and a fourth wall surface;

said wall surfaces are formed to blend smoothly into one another in a peripheral direction;

said first wall surface lies opposite said third wall surface and said second wall surface lies opposite said fourth wall surface; and said thumb support groove is formed in said first wall surface, said at least one finger support groove is formed in said third wall surface, and said second wall surface is formed substantially as a saddle for supporting a ball of the thumb.

4. The pencil sharpener according to claim 3, wherein said first wall surface is shaped substantially as a saddle.

5. The pencil sharpener according to claim 3, wherein said third wall surface is formed with a substantially arched cross section having a vertex running transversely to said longitudinal axis, said at least one finger support groove is formed in relation to said vertex to cause a vertex line running parallel to said longitudinal axis on said third wall surface to possess an undulating course, and wherein a remaining surface area is substantially smooth.

6. The pencil sharpener according to claim 3, wherein said fourth wall surface and said second wall surface have a substantially similar shape.

7. The pencil sharpener according to claim 1, wherein said base is formed with a projecting upper flat surface perpendicular to said longitudinal axis.

8. The pencil sharpener according to claim 7, which further comprises, in addition to said at least one finger support groove and to said thumb support groove, finger recesses, configured to support the thumb and the index finger, formed beneath a projecting part of said upper flat surface.

9. The pencil sharpener according to claim 1, wherein said sharpener insert is inserted centrally into said base substantially parallel to said longitudinal axis.

10. The pencil sharpener according to claim 1, wherein said sharpener insert is inserted into a bore formed in said handle and configured to receive sharpening waste.

11. The pencil sharpener according to claim 10, wherein said sharpener insert is removably disposed in said bore to permit emptying of said bore.

12. The pencil sharpener according to claim 10, which comprises a closeable opening formed on an underside of said handle to permit emptying of said bore.

13. The pencil sharpener according to claim 1, wherein said handle is formed of materials possessing different elasticities.

14. The pencil sharpener according to claim 13, wherein said handle is formed of a first material having relatively higher elasticity and a second material having relatively lower elasticity.

15. A method of manufacturing a pencil sharpener as claimed in claim 1, which comprises the following steps:

providing a substantially cylindrical body of a formable mass having dimensions similar to a human hand with a place holder aligned along a cylindrical axis;

securely gripping the body manually to thereby form at least a part of the internal contours of a human hand onto the body to create a formed body;

either using the formed body as a rough pattern for manufacturing the handle in a forming process;

or curing the formed body to form the handle, with the place holder removed before or after curing; and inserting a sharpener insert into the place holder or into an opening created by removing the place holder.

16. The method according to claim 15, which comprises removing the place holder prior to using the formed body as a rough pattern.

17. The method according to claim 15, which comprises selecting the forming process from the group consisting of casting, pouring, injecting, turning, milling and laser machining.

18. The method according to claim 15, wherein the formable mass consists of a kneaded mass made of a thermosetting plastic, and the formed body is cured to form the handle by thermal treatment.

19. The method according to claim 15, which comprises using materials of different plasticity for the formable mass.

20. The method according to claim 19, wherein a material of higher plasticity and a material of lower plasticity are used.

21. A method of manufacturing a pencil sharpener as claimed in claim 1, the method which comprises the following steps:

providing a substantially cylindrical body of a formable mass having dimensions similar to a human hand with a place holder aligned along a cylindrical axis to create room for a sharpener insert;

securely gripping the body manually to thereby form at least a part of the internal contours of a human hand onto the body to create a formed body;

either using the formed body as a rough pattern for manufacturing the handle in a forming process;

or curing the formed body to form the handle, with the place holder removed before or after curing; and inserting a sharpener insert into the place holder or into an opening created by removing the place holder.

22. The method according to claim 21, which comprises removing the place holder prior to using the formed body as a rough pattern.

23. The method according to claim 21, which comprises selecting the forming process from the group consisting of casting, pouring, injecting, turning, milling and laser machining.

24. The method according to claim 21, wherein the formable mass consists of a kneaded mass made of a thermosetting plastic, and the formed body is cured to form the handle by thermal treatment.

25. The method according to claim 21, which comprises using materials of different plasticity for the formable mass.

26. The method according to claim 25, wherein a material of relatively higher plasticity and a material of relatively lower plasticity are used.

* * * * *